US007750271B2

(12) United States Patent
Smith et al.

(10) Patent No.: US 7,750,271 B2
(45) Date of Patent: Jul. 6, 2010

(54) SYSTEMS AND METHODS FOR CONTROLLING OVEN COOKING

(75) Inventors: Charles R. Smith, Simpsonville, KY (US); Tim Worthington, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 561 days.

(21) Appl. No.: 11/243,593

(22) Filed: Oct. 5, 2005

(65) Prior Publication Data

US 2007/0084849 A1 Apr. 19, 2007

(51) Int. Cl.
*A21B 1/00* (2006.01)

(52) U.S. Cl. ..... 219/413; 219/391; 219/412

(58) Field of Classification Search ..... 219/200, 219/385, 391, 400, 412, 413, 494, 497; 700/300
See application file for complete search history.

(56) References Cited

U.S. PATENT DOCUMENTS 3,315,063 A 4/1967 Ihlenfeldt
4,301,509 A * 11/1981 Haase et al. ..... 700/300
4,554,437 A 11/1985 Wagner et al.
4,908,760 A * 3/1990 Sinn ..... 700/90
5,793,022 A 8/1998 Klinck et al.
6,472,640 B2 * 10/2002 Brown et al. ..... 219/400
6,570,136 B1 5/2003 Lockwood et al.
2003/0015518 A1 1/2003 Baker et al.

* cited by examiner

*Primary Examiner*—Thor S Campbell
(74) *Attorney, Agent, or Firm*—George L. Rideout, Esq.; Armstrong Teasdale LLP

(57) ABSTRACT

A control system for an oven includes a temperature sensor configured to detect a cavity temperature within the cavity, and a controller operatively coupled with the sensor. The oven includes a body having a cavity defined therein and at least one heater positioned within the cavity. The controller is also configured to receive a signal from the sensor, to calculate a rate of temperature change of the cavity temperature, and to adjust a power level of the heater based on the cavity temperature and the calculated rate of temperature change.

25 Claims, 2 Drawing Sheets

SYSTEMS AND METHODS FOR CONTROLLING OVEN COOKING

BACKGROUND OF THE INVENTION

This invention relates generally to ovens and, more particularly, to control systems for ovens to facilitate more even cooking.

In thermal/convection ovens, the food is cooked by the air in the cooking cavity, which is heated by a heat source. Standard thermal ovens do not have a fan to circulate the hot air in the cooking cavity. Some convection ovens use the same heat source as a standard thermal oven, but add a fan to increase cooking efficiency by circulating the hot air around the food. Thermal/convection ovens can be used to cook a wide variety of foods.

Evenness of cooking is desirable for the ovens. Some known ovens monitor the cavity temperature, and turn on/off the heat source when the monitored temperature is below/above a predetermined value. However, known ovens inject a considerable amount of energy into the cooking cavity in a relatively short time period, such that the cavity temperature may not be timely and precisely controlled. Therefore, at least some known ovens have a cavity temperature variation of more than 20 degrees Fahrenheit, which may lead to uneven cooking and causes variation in browning and a darkening around the edges in baked products.

BRIEF DESCRIPTION OF THE INVENTION

In one aspect, a control system for an oven is provided. The oven includes a body having a cavity defined therein and at least one heater positioned within the cavity. The control system includes a temperature sensor configured to detect a cavity temperature within the cavity, and a controller operatively coupled with the sensor. The controller is also configured to receive a signal from the sensor, to calculate a rate of temperature change of the cavity temperature, and to adjust the power level of the heater based on the cavity temperature and the calculated rate of temperature change.

In another aspect, an oven is provided. The oven includes a body having a cavity defined therein, an upper heater and a lower heater positioned within the cavity, a temperature sensor positioned between the upper and lower heaters, the sensor configured to detect a cavity temperature within the cavity, and a controller operatively coupled with the sensor and the heaters. The controller is configured to receive a signal from the sensor, to calculate a rate of temperature change of the cavity temperature, and to adjust the power levels supplied to the upper heater and the lower heater based on both the cavity temperature and the calculated rate of temperature change.

In still another aspect, a method for assembling an oven is provided. The method includes providing a body having a cavity defined therein, positioning at least one heater within the cavity, positioning a temperature sensor within the cavity, the sensor configured to detect a cavity temperature within the cavity, and operatively coupling a controller with the sensor and the heaters. The controller is configured to receive a signal from the sensor and calculate a rate of change of temperature of the cavity temperature. The controller is also configured to adjust the power levels supplied to the heater based on the cavity temperature and the calculated rate of change of temperature.

DETAILED DESCRIPTION OF THE INVENTION

Figure 1:
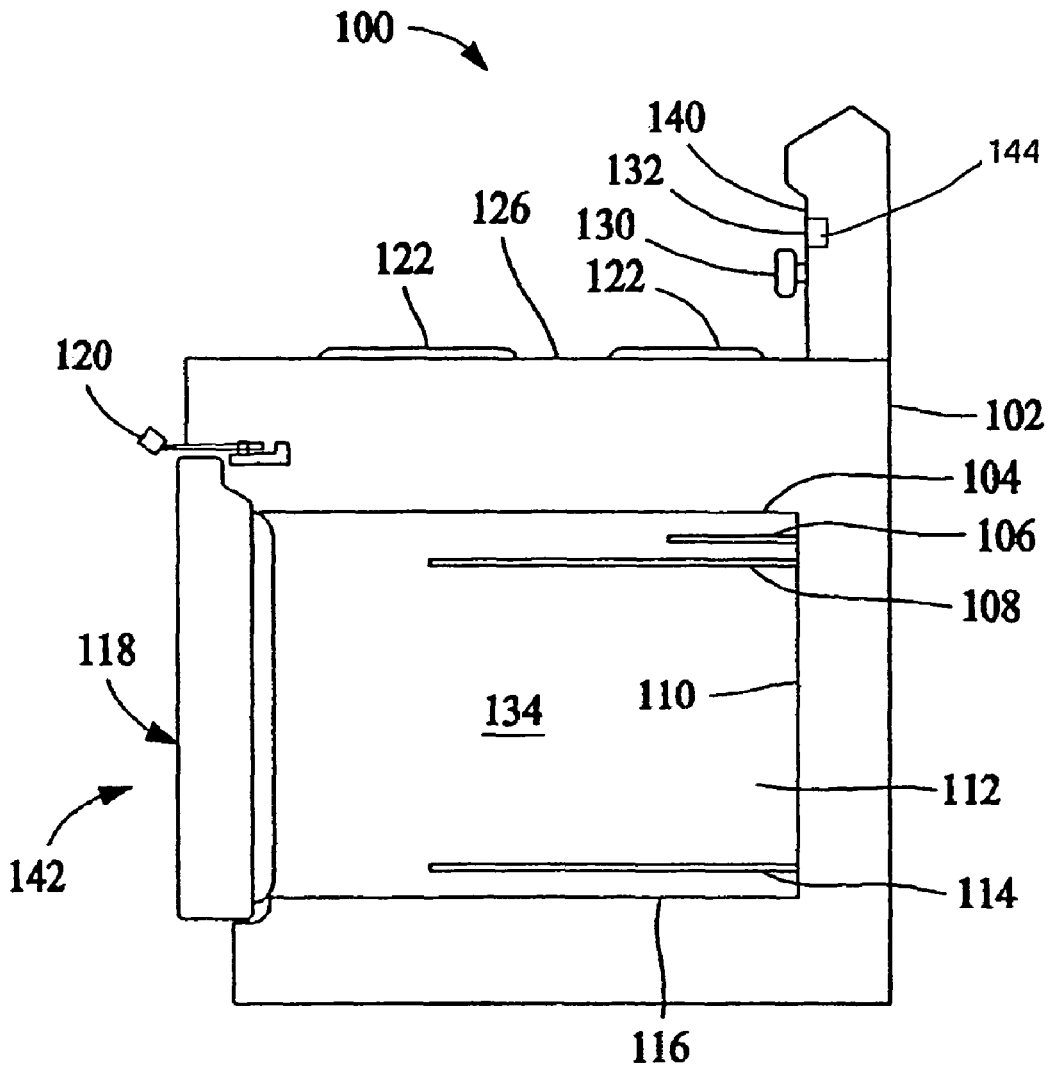
FIG. 1 is a cutaway view of an exemplary electric range including an oven.

FIG. 1 is an embodiment of an exemplary electric range 100 having an oven 142 in which the present invention may be employed. While a free standing electric range is shown, it will be understood that the present invention is equally applicable to other oven products as well. Examples of other oven products include a speedcooking oven, a gas fired oven, a wall oven, and an over the range oven.

Range 100 includes an outer cabinet 102 having a top cooking surface 126 including individual surface heating elements 122. Positioned within cabinet 102 is a cooking chamber or cavity 134 formed by a box-like oven liner having vertical side walls 112, top wall 104, bottom wall 116, rear wall 110 and a front opening drop door 118. Cavity 134 is provided with two heating elements, a bake heating element 114 positioned adjacent bottom wall 116 and a broil heating element 108 positioned adjacent top wall 104. In one embodiment, heating elements 108, 114 are electrical heating elements. It is contemplated, however, that gas fired heating elements and other suitable heating elements known in the art may be employed in alternative embodiments.

A temperature probe or sensor 106 is mounted to project into cavity 134 and senses a temperature within cavity 134. In one embodiment, sensor 106 is positioned between broil heating element 108 and top wall 104. It is contemplated, however, that sensor 106 may be disposed at other positions within cavity 134 in alternative embodiments, such as being positioned between broil and bake heating elements 108, 114. In one embodiment, sensor 106 is positioned at a center of cavity 134. In another embodiment, multiple sensors 106 are positioned within cavity 134.

A door latch handle 120 is used for locking door 118 in a closed position during a self-cleaning operation. A control knob 130 extends outwardly from a control panel 132, which is supported from a back splash 140 of range 100. Control panel 132 also includes a controller 144 for controlling the operation of range 100 and oven 142 according to an operator's selection.

Controller 144 is operatively coupled to sensor 106 for receiving signals representative of the detected cavity temperature from sensor 106, and is also operatively coupled to heating elements 108, 114 for controlling the operation thereof. In one embodiment, controller 144 is coupled to heating elements 108, 114 through relay outputs (not shown) to provide discreet control of heating elements 108, 114. In another embodiment, controller 144 is coupled to heating elements 108, 114 through a triac output (not shown) to provide a continuous power output to heating elements 108, 114. In one embodiment, controller 144 is a proportional integral derivative (PID) based controller.

Figure 2:
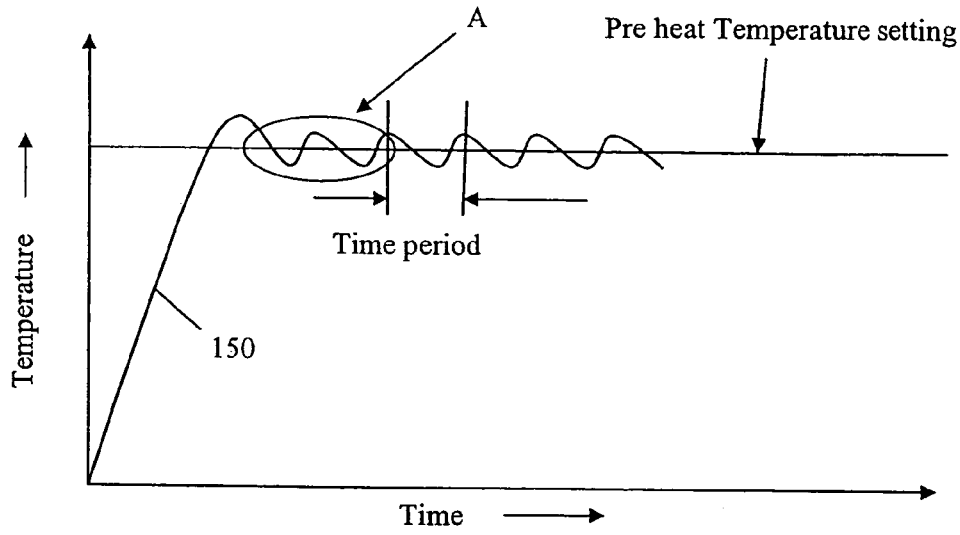
FIG. 2 is a diagram illustrating a cavity temperature curve for known ovens heating to a predetermined temperature.

FIG. 2 is a diagram illustrating a cavity temperature curve 150 when known ovens heating to a predetermined temperature, such as for example, in a preheating process. When heating cavity 134, a considerable amount of energy is introduced into cavity 134 in a relatively short time period, such that the cavity temperature deviates about the predetermined temperature and cannot be kept constant.

Figure 3:
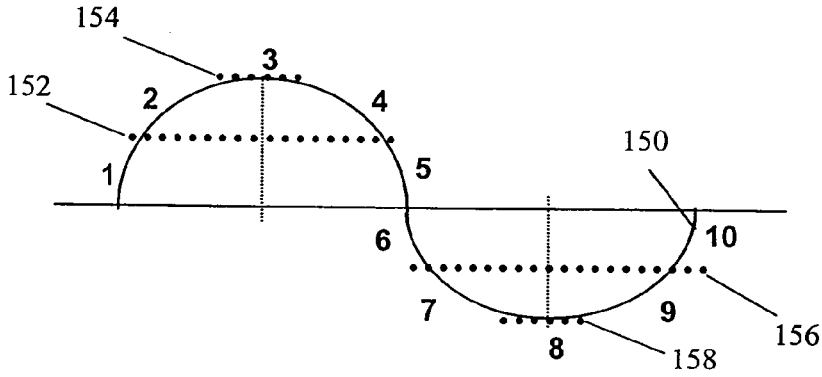
FIG. 3 is an enlarged view of section A of the temperature curve shown in FIG. 2.

FIG. 3 is an enlarged view of a section A of temperature curve 150 shown in FIG. 2. In order to facilitate precisely adjusting the cavity temperature, temperature curve 150 within a predetermined time period is divided into several regions by four dividing lines 152, 154, 156, and 158. In the exemplary embodiment, dividing lines 152, 156 are respectively defined at temperatures of 0.5 degree Fahrenheit above below the predetermined temperature, and dividing lines 154, 158 are respectively defined at temperatures of 1 degree Fahrenheit above/below the predetermined temperature. As such, temperature curve 150 within the predetermined period is divided into ten regions. It is contemplated, however, that the temperatures of the dividing lines, the number of the dividing lines, and the number of the divided regions may be varied in alternative embodiments. In the exemplary embodiment, controller 144 (shown in FIG. 1) accesses a look-up table to control the cavity temperature An exemplary look-up table is shown below:

TABLE 1

Look-Up Table

| Region | Rate | | Error | | Bake % | Broil % |
|---|---|---|---|---|---|---|
| 1 | 0 | 10 | 0 | 0.5 | 25 | 10 |
| 2 | 0 | 10 | 0.5 | 1 | 15 | 5 |
| 3 | −10 | 10 | 1 | 100 | 0 | 0 |
| 4 | −10 | 0 | 0.5 | 1 | 0 | 0 |
| 5 | −10 | 0 | 0 | 0.5 | 0 | 0 |
| 6 | −10 | 0 | −0.5 | 0 | 0 | 0 |
| 7 | −10 | 0 | −1 | −0.5 | 0 | 0 |
| 8 | −10 | 10 | −150 | −1 | 65 | 20 |
| 9 | 0 | 10 | −1 | −0.5 | 50 | 15 |
| 10 | 0 | 10 | −0.5 | 0 | 35 | 15 |

The look-up table pertains to region, rate, error, and power level of heating elements, and each region corresponds to a data group. Each data group includes a range of rate, such as a range of rate of temperature change of the cavity temperature, a range of error, or a temperature difference range with respect to a predetermined temperature, and power level values.

The range of rate and the range of error of each region described in Table 1 correspond to the same region shown in FIG. 3. For example, in region "1" the temperature difference is from 0 to 0.5 degree Fahrenheit above the predetermined temperature, and the rate of temperature change is from 0 to 10 degrees per second i.e. the cavity temperature keeps constant or increases. In region "7", the temperature difference is from 0.5 to 1 degree Fahrenheit below the predetermined temperature and the rate of temperature change is from −10 to 0 degrees per second, temperature decreases or keeps constant.

The power level values of each data region are corresponding to the power levels supplied to heating elements 108, 114 (shown in FIG. 1), and each power level value is defined as a percentage of the full power level that could be supplied to heating element 108, 114. The power level values are predetermined based on several factors of oven 142 (shown in FIG. 1), such as for example, heater power capacity, oven size, oven airflow, rate of oven heat loss, etc. It is contemplated that the power level values may be varied based on different oven factors in alternative embodiments. In the exemplary embodiment, two data groups having identical temperature difference ranges and different changing rate ranges, such as for example, regions "2" and "4", have different power level values.

In operation, controller 144 (shown in FIG. 1) operates heating elements 108, 114 (shown in FIG. 1) to heat cavity 134 (shown in FIG. 1) to a predetermined temperature upon the operator's selection, and receives signals representative of the cavity temperature from sensor 106 (shown in FIG. 1). Controller 144 calculates a temperature difference between the detected cavity temperature and the predetermined temperature and a rate of temperature change of the cavity temperature. Controller 144 then accesses a look-up table, such as the one described in Table 1, compares the calculated temperature difference and the calculated rate of temperature change with the data groups described in Table 1, and adjusts heating elements 108, 114 according to the power level values described in Table 1.

Specifically, if both the temperature difference and the rate of temperature change are within the temperature difference range and the range of rate of temperature change of one of the data groups, controller 144 (shown in FIG. 1) determines that the cavity temperature is within the corresponding region of temperature curve 150, and adjusts heating elements 108, 114 (shown in FIG. 1) according to the power level values of that region. In one embodiment, controller 144 adjusts the power levels supplied to heating elements 108, 114 to different values, respectively. In another embodiment, the power levels of heating elements 108, 114 are adjusted identically. It is contemplated, however, that each data group may include only one power level value, and controller 144 may only operate one of heating elements 108, 114 to heat cavity 134 (shown in FIG. 1) and adjust that heating element according to the only power level value in alternative embodiments.

In the exemplary embodiment, controller 144 (shown in FIG. 1) adjusts heating elements 108, 114 (shown in FIG. 1) based on both the calculated temperature difference and the calculated rate of temperature change. Such as for example, when the temperature differences are both 0.8 degree Fahrenheit above the predetermined temperature, but the rates of temperature change are opposite, controller 144 may pick up the different power level values from regions "2" and "4", respectively. As such, the power level supplied to each heating element 108, 114 may be different when the rates of temperature change are different. In addition, in region "3" or "8", the rate of temperature change is from −10 to 10 degrees per second, i.e., whether the cavity temperature decreases, increases, or keeps constant, it falls within the range of the rate of regions "3" and "8". As such, when the temperature difference is far beyond/below the predetermined temperature, controller 144, in one embodiment, respectively de-energizes/energizes heating elements 108, 114, regardless of the rate of temperature change.

Figure 4:
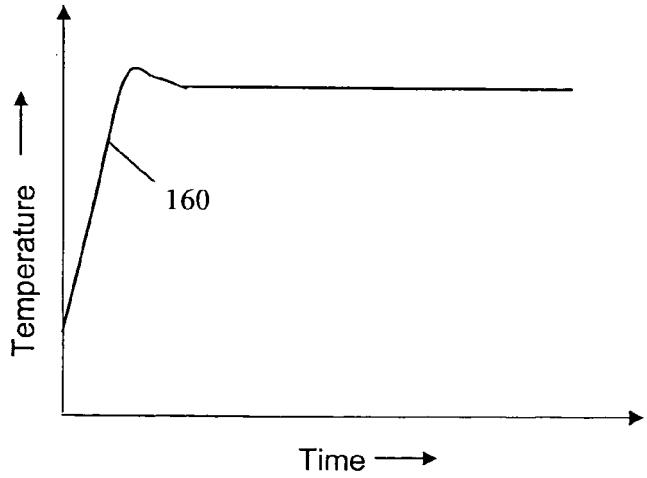
FIG. 4 is a diagram illustrating a cavity temperature curve for the oven shown in FIG. 1 heating to a predetermined temperature.

FIG. 4 is a diagram illustrating a cavity temperature curve 160 controlled by controller 144 (shown in FIG. 1) when oven 142 (shown in FIG. 1) heats to a predetermined temperature, such as for example, in a preheating process.

By adjusting heating elements 108, 114 (shown in FIG. 1) based on both the temperature difference and the rate of temperature change, controller 144 (shown in FIG. 1) facilitates anticipating the future need of oven 142 (shown in FIG. 1) and timely and precisely controls the cavity temperature. As such, in one embodiment, upon oven 142 reaching a steady state condition, controller 144 keeps the cavity temperature within five degrees Fahrenheit of the steady state temperature. In another embodiment, upon oven 142 reaching a steady state condition, controller 144 keeps the cavity temperature within three degrees Fahrenheit of the steady state temperature. In a further embodiment, upon oven 142 reaching a steady state condition, controller 144 keeps the cavity temperature within one degree Fahrenheit of the steady state temperature. Controller 144 reduces thermal gradients within oven cavity 134, facilitates evenness of cooking, and avoids variation in browning and darkening in cooked products.

While the invention has been described in terms of various specific embodiments, those skilled in the art will recognize that the invention can be practiced with modification within the spirit and scope of the claims.

What is claimed is:

1. A control system for an oven including a body defining a cavity and at least one heater positioned within the cavity, said control system comprising:

a temperature sensor configured to detect a cavity temperature within the cavity; and a controller operatively coupled with said temperature sensor, said controller configured to:

receive a signal from said temperature sensor, wherein the signal indicates the cavity temperature;

receive a temperature curve for heating the oven to a first temperature;

divide the temperature curve into a plurality of regions based on the first temperature and at least one temperature deviation from the first temperature;

calculate a rate of change of the cavity temperature based on the received signal and a time period; and adjust a power level of the at least one heater based on the cavity temperature, the calculated rate of change, and one of the plurality of regions of the temperature curve.

2. A control system in accordance with claim 1 wherein upon the oven reaching a steady state condition, said controller facilitates maintaining the cavity temperature within five degrees Fahrenheit of the predetermined temperature.

3. A control system in accordance with claim 1 wherein upon the oven reaching a steady state condition, said controller facilitates maintaining the cavity temperature within three degrees Fahrenheit of the predetermined temperature.

4. A control system in accordance with claim 1 wherein upon the oven reaching a steady state condition, said controller facilitates maintaining the cavity temperature within one degree Fahrenheit of the predetermined temperature.

5. A control system in accordance with claim 1 wherein said controller further configured to:

calculate a temperature difference between the cavity temperature and the predetermined temperature; and adjust the power level of the at least one heater according to the calculated temperature difference.

6. A control system in accordance with claim 5 wherein said controller further configured to define a plurality of data groups, each data group of the plurality of data groups comprising a range of rate of change of the cavity temperature, a temperature difference range, and at least one power level value corresponding to the at least one heater, each data group corresponding to one region of the plurality of regions of the temperature curve.

7. A control system in accordance with claim 6 wherein said controller further configured to compare the calculated temperature difference and the rate of change with said data groups, if both the calculated temperature difference and a changing tendency are within the temperature difference range and the range of rate of change of one of said data groups, said controller configured to adjust the at least one heater according to the corresponding power level value of said data group.

8. A control system in accordance with claim 6 wherein two of the data groups of the plurality of data groups have identical temperature difference ranges, different changing rate ranges, and different power level values.

9. A control system in accordance with claim 1 wherein said controller further configured to de-energize the at least one heater when the cavity temperature is above a predetermined temperature.

10. A control system in accordance with claim 1 wherein said controller configured to access a look-up table that includes information pertaining to one region of the plurality of regions, a rate, an error, and a corresponding power level of plurality of power levels, each power level of the plurality of power levels being a percentage of a full power level.

11. An oven comprising:

a body defining a cavity;

an upper heater and a lower heater positioned within said cavity;

a temperature sensor positioned between said upper heater and said lower heater, said temperature sensor configured to detect a cavity temperature within said cavity; and a controller operatively coupled with said temperature sensor and said upper heater and said lower heater, said controller configured to:

receive a signal from said temperature sensor, wherein the signal indicates the cavity temperature;

receive a temperature curve for heating the oven to a first temperature;

divide the temperature curve into a plurality of regions based on the first temperature and at least one temperature deviation from the first temperature;

calculate a rate of change of the cavity temperature based on the received signal and a time period; and adjust power levels supplied to said upper heater and said lower heater based on the cavity temperature, the calculated rate of change, and one of the plurality of regions of the temperature curve.

12. An oven in accordance with claim 11 wherein upon the oven reaching a steady state condition, said controller facilitates maintaining the cavity temperature within three degrees Fahrenheit of the predetermined temperature.

13. An oven in accordance with claim 11 wherein said controller configured to calculate a temperature difference between the cavity temperature and the predetermined temperature, said controller further configured to adjust the power levels supplied to said upper heater and said lower heater according to the calculated temperature difference.

14. An oven in accordance with claim 13 wherein said controller further configured to define a plurality of data groups, each data group of the plurality of data groups comprising a range of rate of change of the cavity temperature, a temperature difference range, and at least one power level value corresponding to at least one of said upper heater and said lower heater, each data group corresponding to one region of the plurality of regions of the temperature curve.

15. An oven in accordance with claim 14 wherein said controller further configured to compare the calculated temperature difference and the calculated rate of change with said data groups, if both the calculated temperature difference and the rate of change are within the temperature difference range and the range of rate of change of one data group of said plurality of data groups, said controller configured to adjust said upper heater and said lower heater according to the at least one power level value.

16. An oven in accordance with claim 14 wherein two data groups of said plurality of data groups have identical temperature difference ranges, different changing rate ranges, and different power level values.

17. An oven in accordance with claim 11 wherein said controller configured to adjust the power levels supplied to said upper heater and said lower heater to different values.

18. An oven in accordance with claim 11 wherein said controller accesses a look-up table that includes information pertaining to one region of the plurality of regions, a rate, an error, and a corresponding power level of a plurality of power levels.

19. A method for assembling an oven, said method comprising:

providing a body defining a cavity;

positioning at least one heater within the cavity;

positioning a temperature sensor within the cavity, the temperature sensor configured to detect a cavity temperature within the cavity; and operatively coupling a controller with the temperature sensor and the at least one heater, the controller configured to:

receive a signal from the temperature sensor, wherein the signal indicates the cavity temperature;

receive a temperature curve for heating the oven to a first temperature;

divide the temperature curve into a plurality of regions based on the first temperature and at least one temperature deviation from the first temperature;

calculate a rate of change of the cavity temperature based on the received signal and a time period; and adjust a level of power supplied to the at least one heater based on the cavity temperature, the calculated rate of change of the cavity temperature, and one of the plurality of regions of the temperature curve.

20. A method in accordance with claim 19 wherein upon the oven reaching a steady state condition, said controller facilitates maintaining the cavity temperature within three degrees Fahrenheit of the predetermined temperature.

21. A method in accordance with claim 19 wherein said operatively coupling a controller further comprises coupling a controller configured to calculate a temperature difference between the cavity temperature and the predetermined temperature, the controller further configured to adjust the level of power supplied to the at least one heater according to the calculated temperature difference.

22. A method in accordance with claim 21 wherein said operatively coupling a controller further comprises coupling a controller configured to define a plurality of data groups, each data group of the plurality of data groups comprising a range of a rate of temperature change of the cavity temperature, a temperature difference range, and at least one power level value corresponding to the heater, each data group corresponding to one region of the plurality of regions of the temperature curve.

23. A method in accordance with claim 22 wherein said operatively coupling a controller further comprises coupling a controller configured to compare the calculated temperature difference and the calculated rate of change with the plurality of data groups, if both the temperature difference and a changing tendency are within the temperature difference range and the range of rate of change of one data group of the plurality of data groups, the controller configured to adjust the at least one heater according to the corresponding power level value of the one data group.

24. A method in accordance with claim 19 wherein said positioning at least one heater further comprises positioning an upper heater and a lower heater within the cavity, and said operatively coupling a controller further comprises coupling a controller configured to adjust the upper and lower heaters to the different power levels.

25. An oven in accordance with claim 19 wherein said controller accesses a look-up table that includes information pertaining to one region of the plurality of regions, a rate, an error, and a corresponding power level of a plurality of power levels.

* * * * *